US006638126B2

(12) United States Patent
Lariviere

(10) Patent No.: US 6,638,126 B2
(45) Date of Patent: Oct. 28, 2003

(54) PERSONAL FLOATATION DEVICE

(76) Inventor: Yves Lariviere, 5130 Legion, St-Hubert, Quebec (CA), J3Y 1Z6

( * ) Notice: Subject to any disclaimer, the term of this patent is extended or adjusted under 35 U.S.C. 154(b) by 0 days.

(21) Appl. No.: 09/803,730

(22) Filed: Mar. 9, 2001

(65) Prior Publication Data

US 2002/0094735 A1 Jul. 18, 2002

Related U.S. Application Data

(60) Provisional application No. 60/188,418, filed on Mar. 10, 2000.

(51) Int. Cl.[7] ..... B63C 9/08
(52) U.S. Cl. ..... 441/123
(58) Field of Search ..... 441/80, 88, 106, 441/120, 118, 119, 123, 124

(56) References Cited

U.S. PATENT DOCUMENTS

| | | | | | |
|---|---|---|---|---|---|
| 634,445 | A | | 10/1899 | De Wilde | |
| 824,664 | A | | 6/1906 | Krieger | |
| 1,043,367 | A | | 11/1912 | Smack | |
| 1,653,974 | A | | 12/1927 | Walcher | |
| 2,547,333 | A | | 4/1951 | Lund | |
| 3,048,860 | A | | 8/1962 | Richardson | |
| 3,181,183 | A | | 5/1965 | Allen | |
| 3,903,555 | A | * | 9/1975 | Busby | 441/116 |
| 3,956,786 | A | | 5/1976 | O'Link | |
| 3,988,795 | A | | 11/1976 | Robertson | |
| 4,276,670 | A | * | 7/1981 | Marchello et al. | 441/115 |
| 5,746,633 | A | * | 5/1998 | Jeffrey | 441/123 |
| 5,775,967 | A | * | 7/1998 | Lacoursiere et al. | 441/115 |

FOREIGN PATENT DOCUMENTS

| | | | | |
|---|---|---|---|---|
| JP | 0222997 | * | 9/1988 | 441/123 |

* cited by examiner

*Primary Examiner*—Stephen Avila
(74) *Attorney, Agent, or Firm*—Darby & Darby

(57) ABSTRACT

A personal floatation device comprising: first means comprising at least a buoyant member provided with a neck receiving opening; and second means allowing to apply the weight of the wearer to said first means; wherein said second means are positioned underneath said first means to position the center of gravity of a combination "wearer—personal floatation device" substantially under the water level and prevent overturning of the same.

13 Claims, 8 Drawing Sheets

PERSONAL FLOATATION DEVICE

This application claims priority under 35 U.S.C. §120 from U.S. Provisional Application No. 60/188,418, filed Mar. 10, 2000, the entire disclosure of which is incorporated by reference herein.

BACKGROUND OF THE INVENTION a) Field of the Invention

The invention relates to a personal floatation device which when worn by a person, is prevented to overturn. This personal floatation device is particularly suited for handicaped persons.

b) Description of the Prior Art

Floatation devices provided with one or several buoyant members to be positioned around a neck of a person are described in U.S. Pat. Nos. 634,445 (DE WILDE), 824,664 (KRIEGER), 1,043,367 (SMACK), 1,653,974 (WALCHER), 2,547,333 (LUND), 3,048,860 (RICHARDSON), 3,956,786 (O'LINK) and 3,988,795 (ROBERTSON). More particularly, U.S. Pat. No. 1,043,367 (SMACK) describes a neck life ring comprising two rigid half sections hinged together, under arm straps, devices carried by the ring and engaging the under arm straps. Said under arm straps are arranged to draw the two ring sections together around the neck of the wearer and snugly down onto the shoulders of the wearer and hold the ring in such position, when secured. Said connecting devices for the straps pass through the ring from the bottom to the top thereof for transmitting the strain on the straps due to the weight of the wearer, to the top of the ring. This device does not allow to prevent overturning of the combination "wearer—neck life ring". Because the harness is in the vicinity of the surface of water, if the wearer become unconscious, it is possible he had his face in water due to the rise of the remain of the body to the surface.

None of the prior art discloses a personal floatation device allowing to prevent overturning of the combination wearer—personal floatation device.

SUMMARY OF THE INVENTION

The present invention relates to a personal floatation device having when worn by a person, a center of gravity positioned substantially under the surface of water, to thus overcome substantially the problems and disadvantages encountered with the existing prior art.

It is an object of the present invention to provide a personal floatation device, which when worn by a person, positions the center of gravity of a combination "wearer—personal floatation device" substantially under the water surface to thus prevent overturning of said combination. This substantial lowering of the center of gravity works similarly to a ballast keel of a sailing ship.

It is another object of the present invention to maintain the head of the wearer above the water level and a buoyant member provided with a neck receiving opening. More particularly, even the chin of the wearer is maintained above the water level and the buoyant member.

It is another object of the present invention to provide a personal floatation device that is particularly suited for handicaped persons. Indeed, the wearer will be maintain into a substantially vertical position in water (with his head above the water level and the buoyant member) and no pressure will be applied against the head of the wearer.

It is another object of the present invention to provide a personal floatation device that does not interfere with mobility of the limbs of the wearer. This is particularly useful when the wearer has to do exercises in a swimming pool.

It is another object of the present invention to provide a personal floatation device that can be adjusted to wearer of various sizes.

It is a particularly preferred embodiment of the invention to provide a personal floatation device comprising:

first means comprising at least a buoyant member provided with a neck receiving opening; and second means allowing to apply the weight of the wearer to said first means; wherein said second means are positioned underneath said first means to position the center of gravity of a combination "wearer—personal floatation device" substantially under the water level and prevent overturning of the same.

Advantageously, the buoyant member may be made or may comprise any material having buoyant properties. Preferably, the material having buoyant properties may consist of expanded polypropylene polymer.

Advantageously, the buoyant member may have sufficient flexibility to allow an easy insertion of the neck of the wearer in the neck receiving opening, and may have sufficient rigidity to be able to substantially keep its original shape in normal condition of use.

According to another particularly preferred embodiment, saids second means comprises a harness, advantageously a harness comprising a saddle.

According to another particularly preferred embodiment, the harness comprises a saddle, advantageously made of fabric material, and a set of at least two straps, advantageously made of fabric material. Each strap has a first end and a second end. Saids first ends are connected to the bottom of the buoyant member (preferably with seams or any other appropriate means) while the second ends are connected to the saddle (preferably with seams or any other appropriate means). Preferably, the saddle has a fore part and a rear part, and at least one of said second ends is connected to said fore part of the saddle and is intended to pass at the crotch of the wearer, and at least one of said second ends is connected to said rear part of said saddle.

According to a particularly preferred embodiment, the invention relates to a personal floatation device wherein the harness is made of two distinct sections.

A first section comprises a set of four straps evenly distributed around the periphery of a buoyant member. Each straps has a first end and a second end, the first end being fastened to the buoyant member, while the second end is fastened to one part of a two part fastener.

A second section comprises three sets of straps. A first set of straps may comprises two straps having opposite ends and removably fastened together (e.g. with two part fastener), to define a belt to be wear at the waist of the wearer. A second set of straps comprises two straps having opposite ends, one end being fastened to one strap of the first set of straps, one end of the other strap being fastened to the other strap of the first set of straps. The opposite end of both straps are fastened together with an adjustment buckle. A third set of four straps having opposite ends, one end being fastened to a corresponding strap of the belt, while the opposite end is fastened to the other part of a two part fastener of the first section.

A portion of one strap of the second set of straps and a portion of one strap of the third set of straps are fastened to a saddle. The strap of the third set of straps which is fastened to the saddle passes between legs of the wearer, more particularly at the crotch of the wearer. The second section may preferably define a trouser.

According to a particularly preferred embodiment, the invention relates to a personal floatation device wherein the buoyant member comprises a collar made of a fabric material, said collar being provided with a neck receiving opening, a periphery, a slit communicating with the neck receiving opening and optionally with a periphery of said collar, fastening means to removably fasten opposite sides of the slit a housing and at least one buoyant element enclosed in the housing of said collar. Advantageously, said fastening means comprise at least one set of VELCRO® fasteners, and more preferably two sets of VELCRO® fasteners.

According to a particularly preferred embodiment, the invention relates to a personal floatation device wherein the straps and the saddle are made of a fabric material, wherein saids straps are fastened to the fabric material of the collar with any appropriate means such as seams, rivets, glue, ect., (preferably with seams); and wherein saids straps are fastened to the saddle with any appropriate means such as seams, rivets, glue, ect., (preferably with seams).

According to a particularly prefered embodiment, the invention relates to a personal floatation device wherein saids straps are each further provided with means allowing to adjust their length. Preferably, said means allowing to adjust the length of each strap may comprise an adjustment buckle.

The invention also comprises such other objects, advantages and capabilities as will later more fully appear and which are inherently possessed by the invention.

While there is shown in the accompanying drawings a preferred embodiment of the invention, it should be understood that the same is susceptible of modification and change without departing from the spirit of the invention.

DETAILED DESCRIPTION OF THE PREFERRED EMBODIMENT

Figure 1:
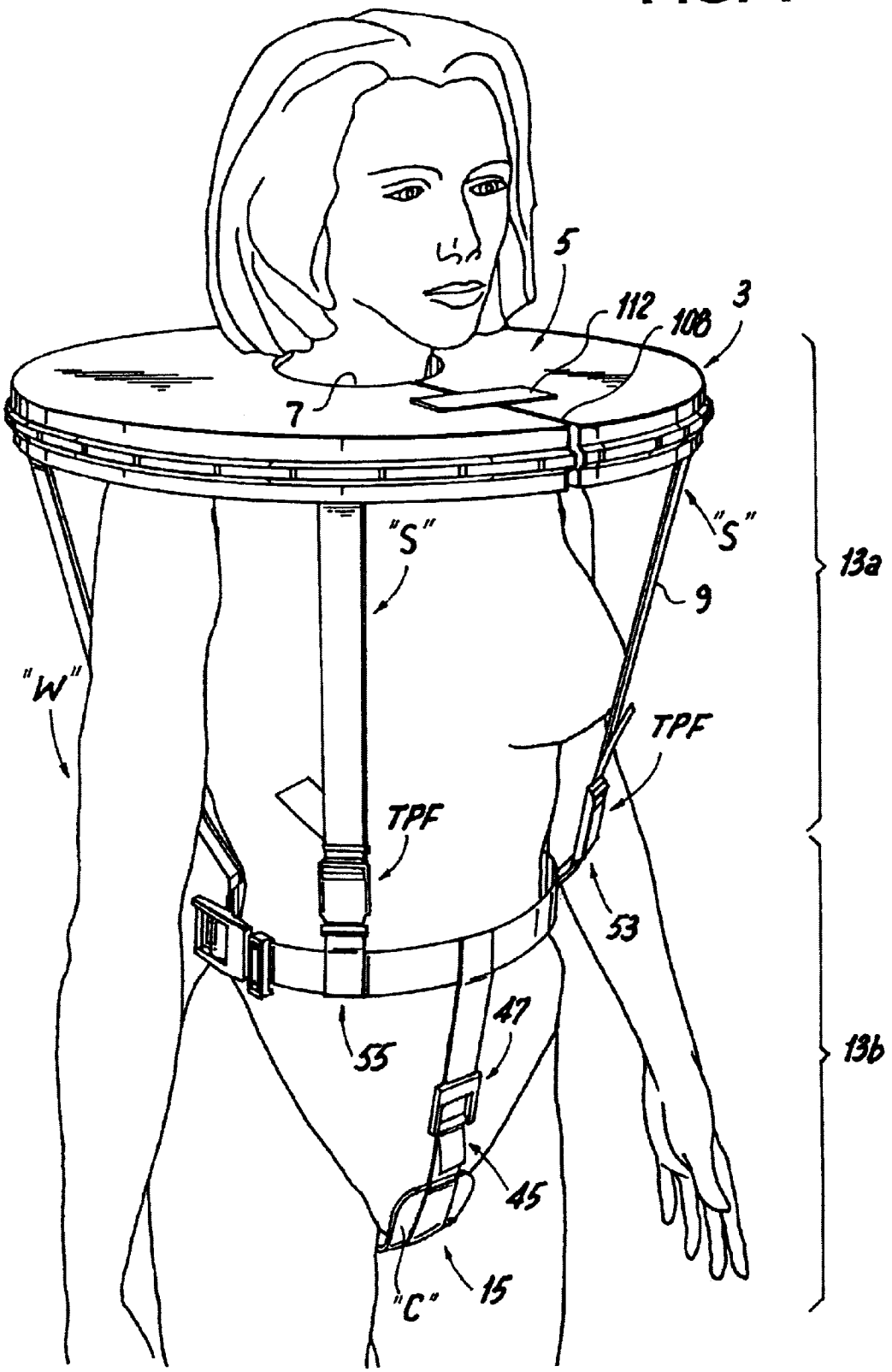
FIG. 1 is a perspective view of a person wearing a personal floatation device according to the invention.
Figure 2:
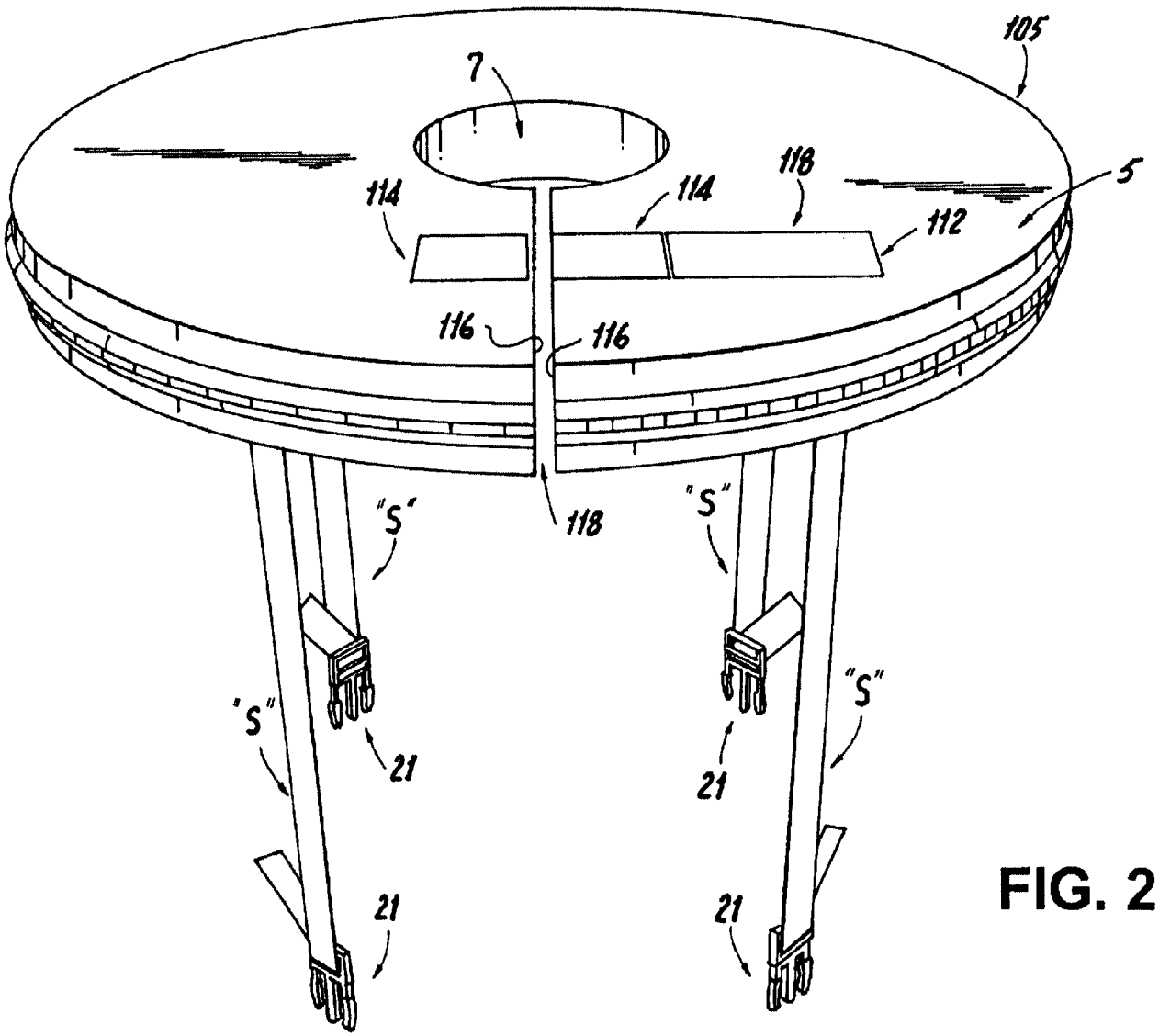
FIG. 2 is a perspective view of an upper portion of the personal floatation device of FIG. 1.
Figure 3:
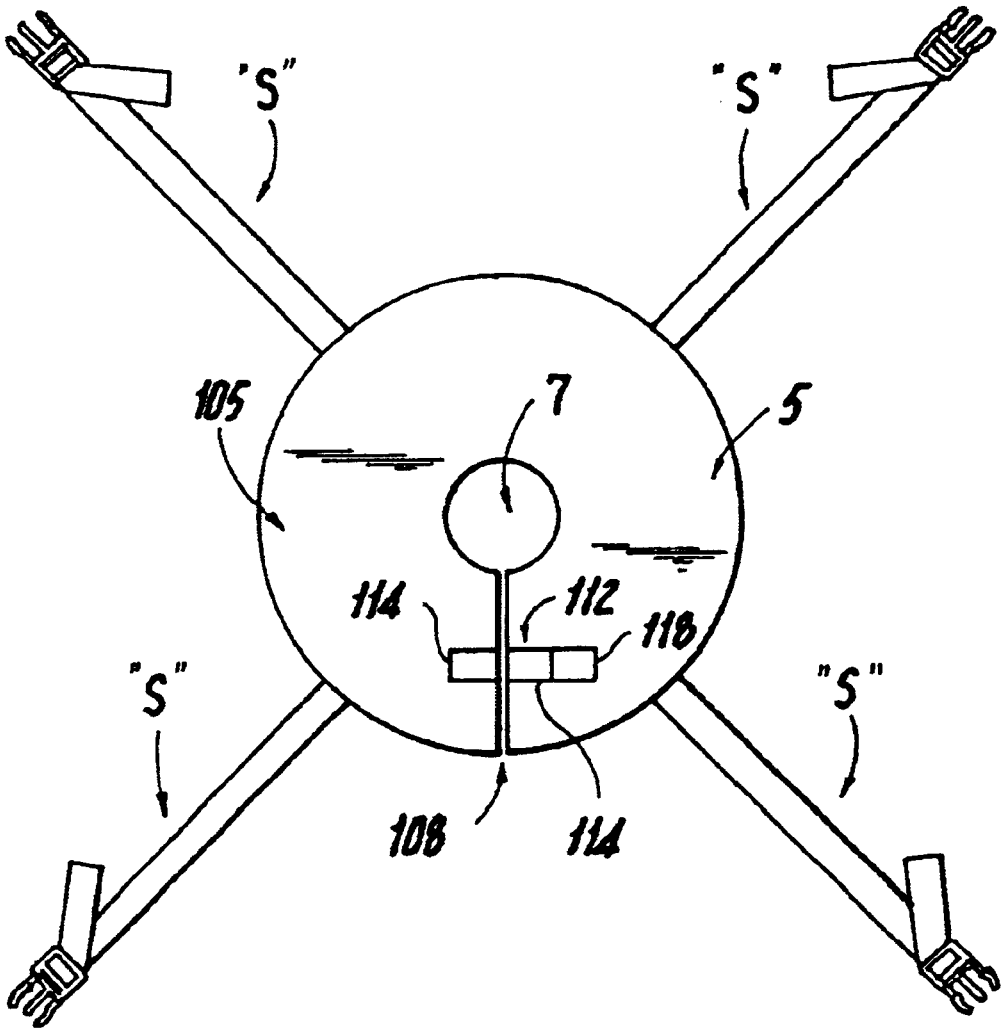
FIG. 3 is a top plane view of the upper portion shown in FIG. 2.
Figure 4:
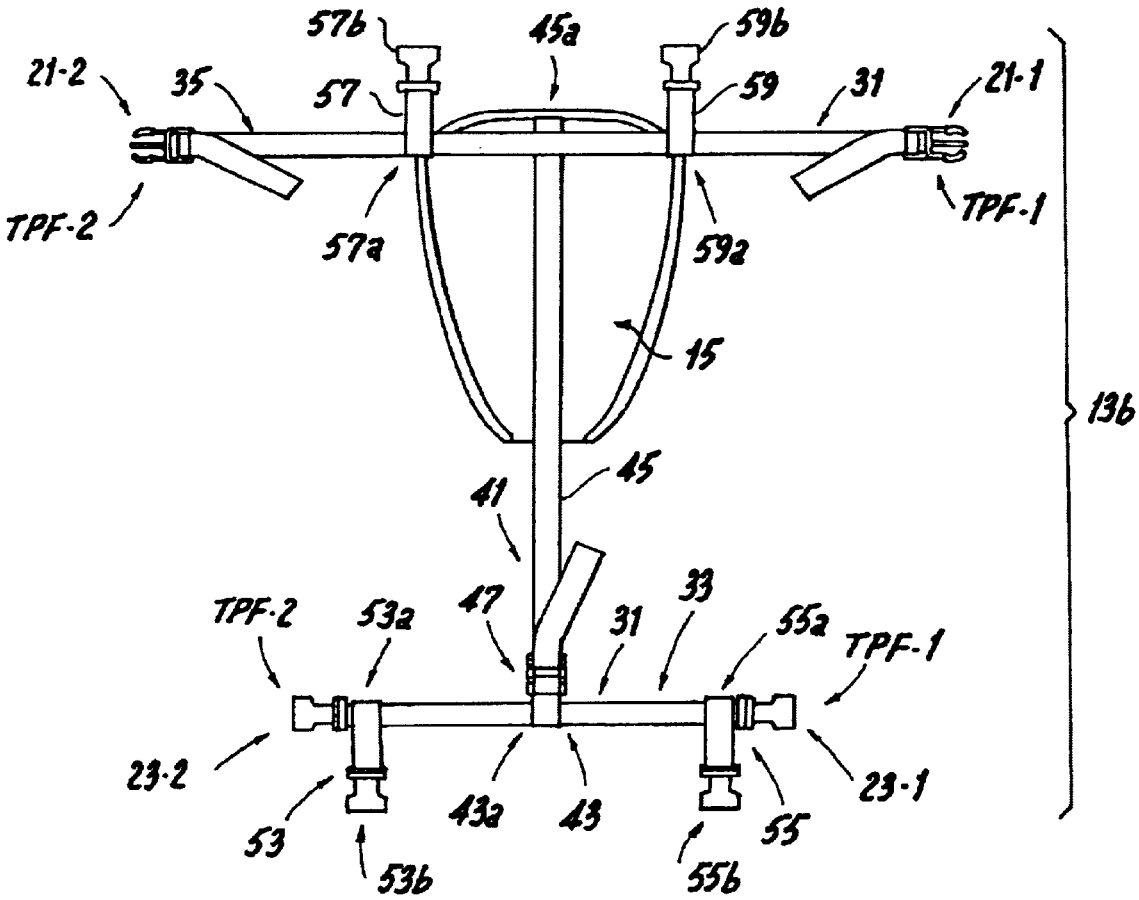
FIG. 4 is a top plane view of a lower portion of the personal floatation device of FIG. 1.

With reference to the enclosed drawings, the invention preferably relates to a personal floatation device 1 comprising:

first means 3 comprising at least a buoyant member 5 provided with a neck receiving opening 7; and second means 9 to apply the weight of the wearer "W" to said first means 3; wherein said second means 9 are positioned underneath said first means 3 to position a center of gravity of the resulting combination "wearer—personal floatation device" substantially under the water level and prevent overturning of the same.

As illustrated, the second means 9 advantageously comprises a harness 13 and more preferably a harness 13 provided with a saddle 15. Advantageously, the harness 13 and the saddle 15 are made of a fabric material. Any appropriate fabric material may be selected. Preferably, it is preferred to use a nylon fabric material.

Figure 9:
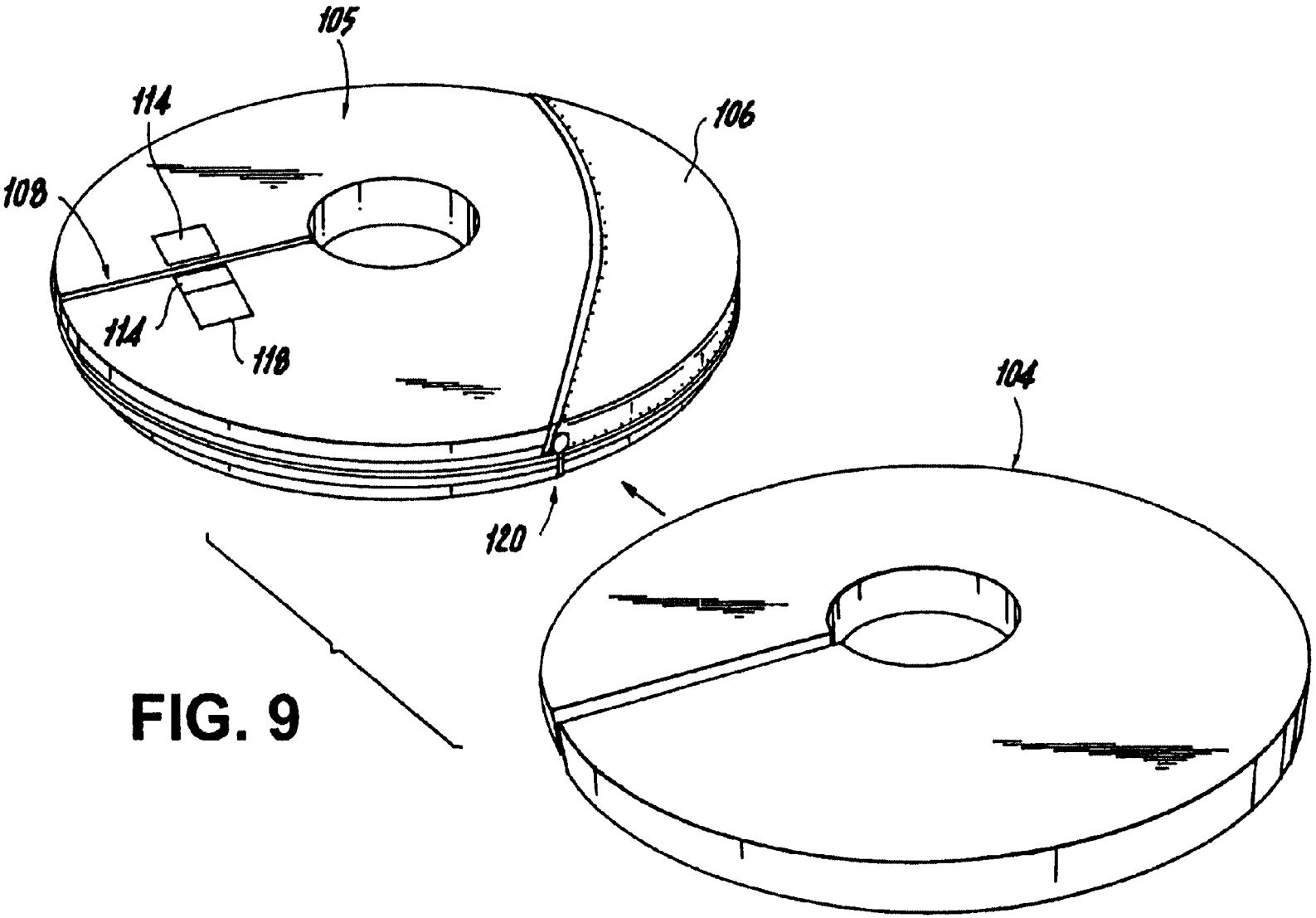
FIG. 9 is an exploded view of a buoyant member.

As illustrated in FIG. 9, the buoyant member preferably consists of a collar 105 made of a fabric material, said collar being provided with a neck receiving opening 7, a slit 108, a housing 106, a buoyant element 104 enclosed in said housing and VELCRO® fasteners 112.

In the case of intellectually handicaped persons or child, the slit 108 and the VELCRO® fasteners 112 may be positioned behind the head of the wearer to prevent this wearer to disengage said fasteners 112.

Optionally, the collar 105 may be provided with means allowing an easy introduction in the housing 106 or removal of the buoyant element 104 from the housing 106. Said means may consist of any appropriate means and preferably consist of a zipper means 120.

According to a particularly prefered embodiment illustrated in the drawings, the harness 13 is made of a first section 13*a* and a second section 13*b*.

Figure 7:
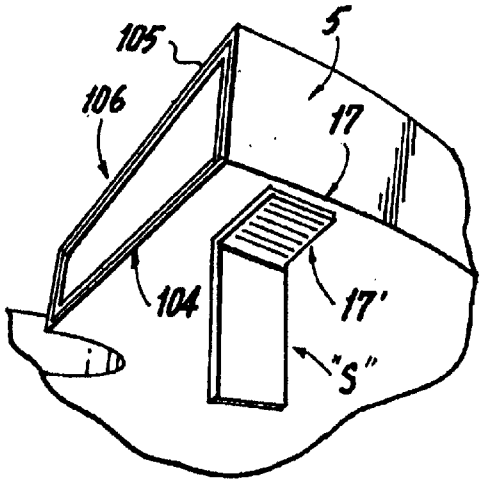
FIG. 7 is a partial perspective view of how a strap is connected to the buoyant member.
Figure 6:
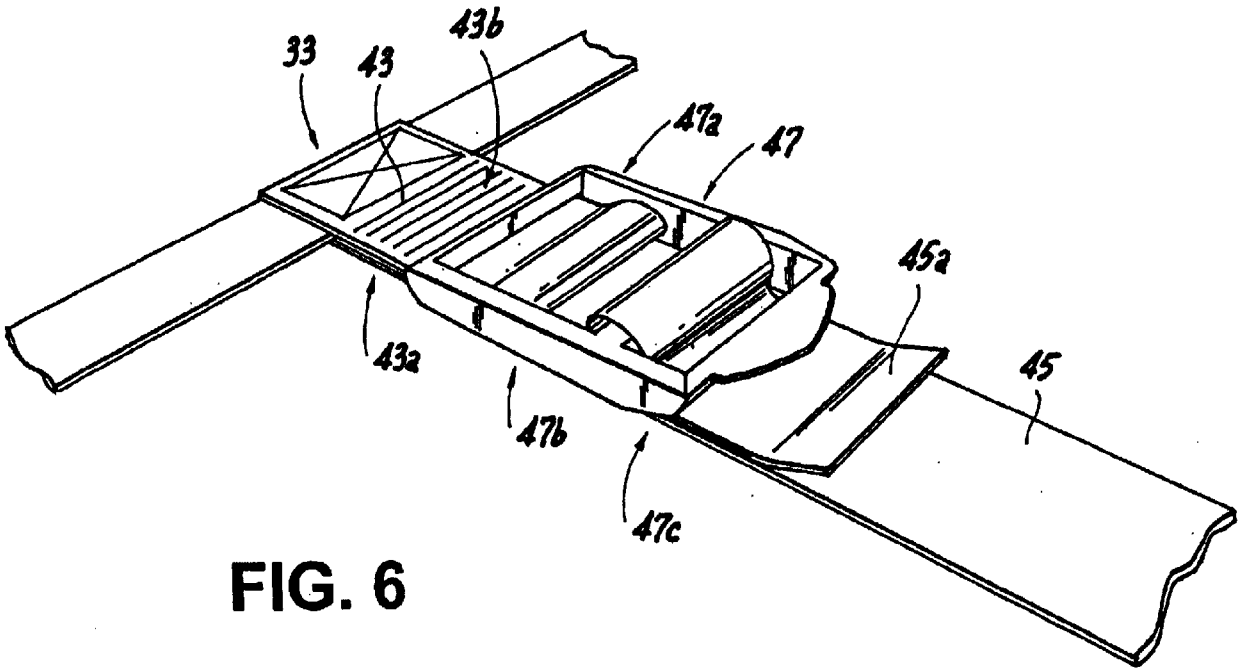
FIG. 6 is a perspective view of an adjustment buckle.

The first section 13*a* comprises a set of four straps "S" evenly distributed around a periphery of a buoyant member 5. Each straps has a first end 17 and a second end 18. Each first end 17 is fastened to the buoyant member by any appropriate means such as with seams, glue, ect. Preferably, with reference to FIG. 7, the first end 17 is fastened to the bottom of the member 5 with seams 17'. The second end 18 is either fastened by any appropriate means well known in the art, such as with seams, glue, ect. to a first part of a two part fastener "TPF" comprising a first part 21 and a second part 23, or engaged into a tightening buckle 21*a* (of a type well known in the art, for example see FIGS. 5 and 5*a*), said buckle 21*a* making an integral part of the first part 21.

Figure 5:
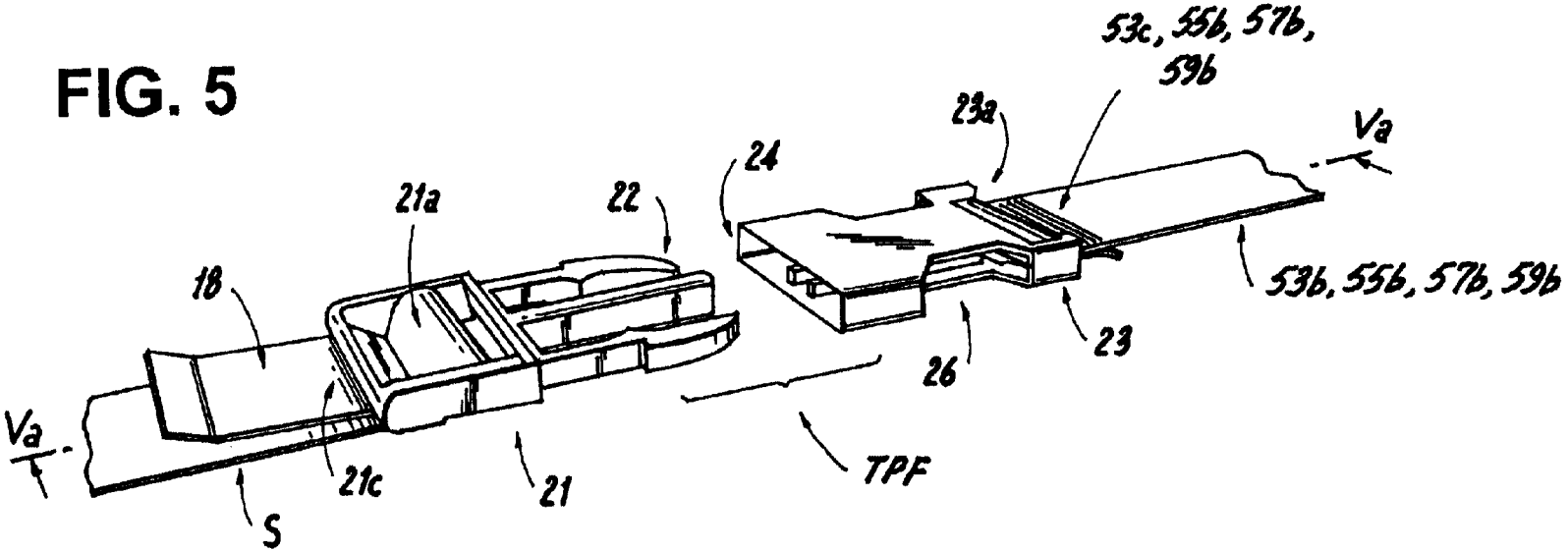
FIG. 5 is an exploded view of a two part fastener.
Figure 5A:
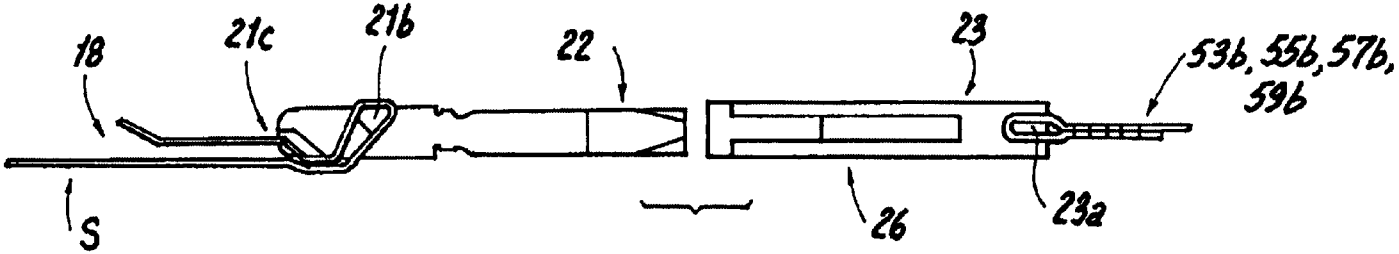
FIG. 5*a* is a cross sectional view according to Va—Va of the two part fastener of FIG. 5.

A two part fastener "TPF" of the type illustrated in FIGS. 5 and 5*a* is well known and does not need an extensive description. Parts 21 and 23 are made of plastic material. To fasten, members 22 are slid in the housing 24 and engaged in openings 26. To unfasten, members 22 are pushed from openings 26 and slid from the housing 24. Advantageously, the tightening buckle 21*a* of the first part 21 is engaged by a portion of the strap "S" which is folded around members 21*b* and 21*c* said buckle 21*a*, and slid until a desire length is obtained. Then portions of straps are pressed one against the other so as friction locks said strap into a tightened position. Such a tightening buckle is well known in the art. The second part 23 is also provided with a buckle 23*a*. In that case, the strap 53, 55, 57 or 59 may be merely pass around the buckle and fold to define a loop. Then the end is fastened to said strap 53, 55, 57 or 59 with seams 53*c*, 55*c*, 57*c* or 59*c*.

The second section 13*b* comprises three sets of straps 31, 41 and 51. The set of straps 31 comprises straps 33 and 35, each having opposite ends and fastened together, with two part fasteners "TPF-1" and "TPF-2", define a belt to be wear at the waist of the wearer "W". Each two part fasteners "TPF-1" and "TPF-2" is similar to the two part fastener "TPF", except reference number are identified with extension "−1" or "−2".

The set of straps 41 comprises two straps 43 and 45 having opposite ends. The strap 43 has one end 43-*a* fastened to the strap 33, and the opposite end 43-*b* fastened to an adjustment buckle 47. The strap 45 has one end 45-*a* fastened to the strap 35, and the opposite end 45-*b* fastened to an adjustment buckle 47. More particularly, the end 43-*b* is passed around member 47-*a* of the buckle 47 and bent to form a loop. The end 43-*b* is fastened to the strap 43 by any appropriate means such as with seams, rivets, glue, ect. Advantageously, seams 43*b* are used. More particularly, the end 45-*b* is folded around members 47-*b* and 47-*c* of said buckle 47, and slid until a desire lenght is obtained, and then portions thereof are pressed one against the other so as friction locks said strap into a tightened position.

The set of straps 51 comprises four straps 53, 55, 57 and 59, each having opposite ends. Straps 53 and 55 have one end 53-*a* and 55-*a* fastened to the strap 33, and the opposite end 53-*b* and 55-*b* fastened to a second part 23 of a corresponding two part fastener "TPF". Straps 57 and 59 have one end 57-*a* and 59-*a* fastened to the strap 35, and the opposite end 57-*b* and 59-*b* fastened to a corresponding second part of a corresponding two part fastener "TPF".

A portion of one of the strap 45 and a portion of the strap 35 are fastened to a saddle 15 and the strap 45 passes between legs of the wearer "W", more particularly at the crotch "C" of the wearer "W". Advantageously, the saddle 15 is fastened to straps 35, 45 by any appropriate means, preferably with seams 15*c*.

Advantageously, the buoyant member 5 comprises a collar 105 made of a fabric material, said collar 105 being provided with a housing 106 and with a slit 108 communicating with the neck receiving opening 7 and a periphery of said collar 105. At least one buoyant element 104 is enclosed in the housing 106. The collar 105 preferably defines a fabric enveloppe adapted to define an inner cavity corresponding to the housing 106. Fastening means are provided to removably fasten opposite sides 116 of the slit 108. Advantageously, said fastening means comprise two sets of VELCRO® fasteners 112. More particularly, two felted portions 114 of the VELCRO® fasteners 112 are respectively fastened on both sides 116 of the slit 108 by any appropriate means (e.g. with seams), while a hooked portion 118 of said VELCRO® fasteners 112 is fastened on one side and allowed to engage both corresponding felted portions 114.

Figure 8:
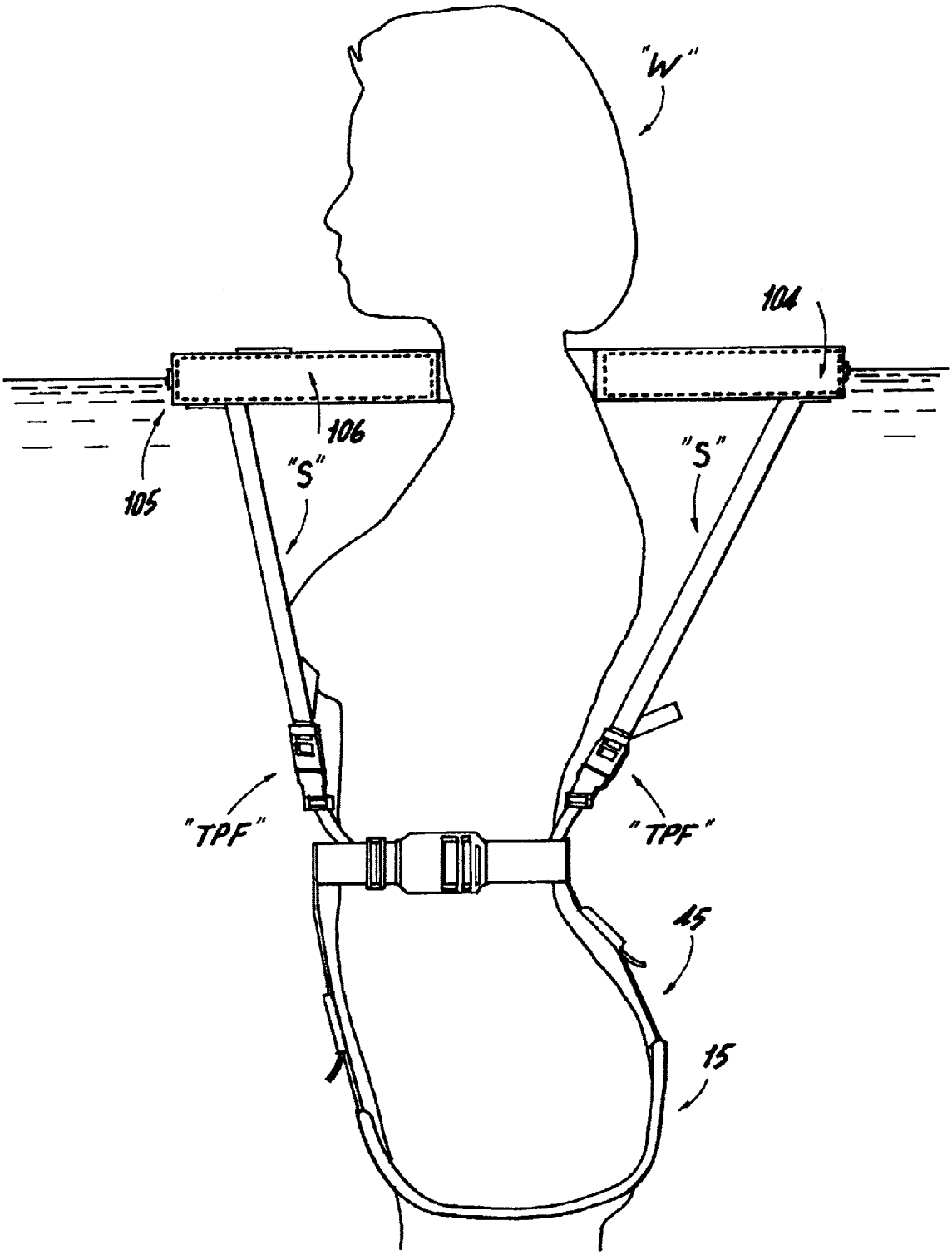
FIG. 8 is a schematic view of how the personal floatation device works.

To use a the particularly preferred personal floatation device defined with reference to the drawings, a person only has to carry out the following steps:

- to disengage the hooked portion 118 of the VELCRO® fasteners 112;
- insert his neck in the neck receiving opening 7;
- re-engage the hooked portions 118 of the VELCRO® fasteners 112 against the corresponding felted portions 114;
- engage two part fasteners "TFP" of straps 33 and 35, eventually adjust the length of the resulting belt, by sliding the straps in adjustment buckle making an integral part of said two part fasteners,
- engage the strap 45 in the adjustment buckle 47, slid said strap 45 to position the saddle 15 against buttock of the wearer, and lock said strap 45 by friction in said buckle 47;
- engage two part fasteners "TPF" of straps 53, 55, 57 and 59, eventually adjust the length of straps 53, 55, 57 and 59 by sliding the straps in corresponding adjustment buckle to preferably position the head of the wearer above the buoyant member 5, and more particularly to position the chin of the wearer above the buoyant member 5. Then the person is ready to come into the water. He will float substantially as illustrated in FIG. 8.

To remove the device according to the invention, aforesaid steps are merely reversed.

Example of size for the collar may be:

For an adult: exterior diameter of the buoyant member: 21 inches interior diameter of the neck receiving opening: 5.5 inches thickness of the buoyant member: 2.5 inches.

For an child: exterior diameter of the buoyant member: 18 inches interior diameter of the neck receiving opening: 4.5 inches thickness of the buoyant member: 1.25 inch.

Advantageously, the buoyant element may be selected amongst all existing buoyant material and more particularly it may consist of PPE VLDP (expanded polypropylene—very low density polymer) having a density of 0,90 and in the case of buoyant member of small thickness (e.g. for a child) it may preferably consist of PPE MDP (expanded polypropylene—medium density polymer) having a density of 1,90.

Advantageously, the collar 105, the saddle 15 and the straps may be made of any appropriate material, and preferably of a nylon fabric.

What is claimed is:

1. A personal floatation device comprising:

first means comprising at least a buoyant member provided with a neck receiving opening; and second means to apply the weight of the wearer to said first means;

wherein said second means are positioned underneath said first means to position a center of gravity of the resulting combination wearer—personal floatation device substantially under the water level and prevent overturning of the same;

wherein said second means comprises a harness and said harness comprises a saddle and said harness and said saddle are positioned underneath the first means;

wherein the harness comprises a set of straps, wherein each strap has a first end and a second end, and wherein said first ends are connected to the buoyant member while the second ends are connected to the bottom of the saddle;

wherein the saddle has a fore part and a rear part, and wherein at least one of said first ends is connected to a fore part of the saddle and is intended to pass at the crotch of the wearer, and at least one of said first ends is connected to a rear part of said saddle; and wherein the buoyant member comprises a collar provided with a slit communicating with the neck receiving opening and a periphery of said collar; and wherein fastening means are provided to removably fasten opposite sides of the slit.

2. A personal floatation device according to claim 1, wherein the saddle and the straps are made of a fabric material.

3. A personal floatation device according to claim 2, wherein the collar comprises a housing and at least one buoyant element is enclosed in the housing of said collar.

4. A personal floatation device according to claim 3, wherein said fastening means comprise two sets of VELCRO® fasteners.

5. A personal floatation device according to claim 3, wherein the straps and the saddle are made of a fabric material, wherein saids straps are fastened to the fabric material of the collar with seams; and wherein saids straps are fastened to the saddle with seams.

6. A personal floatation device according to claim 5, wherein saids straps are each further provided with means allowing to adjust their length.

7. A personal floatation device according to claim 6, wherein means allowing to adjust the length of each strap comprises an adjustment buckle.

8. A personal floatation device comprising in combination:

first means comprising at least a buoyant member provided with a neck receving opening, said buoyant member comprising a collar made of a fabric material, said collar being provided with a housing and with a slit communicating with the neck receiving opening and a periphery of said collar; wherein at least one buoyant element is enclosed in the housing of said collar; and wherein fastening means are provided to removably fasten opposite sides of the slit;

second means to apply the weight of the wearer to said first means, wherein said second means are positioned underneath said first means to position the center of gravity of the resulting combination wearer—personal floatation device substantially under the water level and prevent overturning of the same, wherein said second means define a harness comprising a first section and a second, the first section comprising a set of four straps evenly distributed around the periphery of a buoyant member, each straps having a first end and a second end, the first end being fastened to the buoyant member, while the second end is fastened to one part of a two part fastener; a second section comprising a first set of straps, a second set of straps and a third set of straps, the first set of straps comprising two straps having opposite ends and fastened together to define a belt to be wear at the waist of the wearer, the second set of straps comprising two straps having opposite ends, one end being fastened to one strap of the first set of straps, one end of the other strap being fastened to the other strap of the first set of straps, and the remaining end of both straps being fastened together with an adjustment buckle; and a third set of four straps having opposite ends, one end being fastened to a corresponding strap of the belt, while the opposite end is fastened to the other part of a two part fastener of the first section, a portion of one of the strap of the second set and a portion of one of the strap of the third set of strap being fastened to a saddle, and the strap of the third set of straps which is fastened to the saddle passing between legs of the wearer.

9. A personal floatation device according to claim 8, wherein said collar is provided with a housing and with a slit communicating with the neck receiving opening and a periphery of said collar; wherein at least one buoyant element is enclosed in the housing of said collar; and wherein fastening means are provided to removably fasten opposite sides of the slit.

10. A personal floatation device according to claim 9, wherein said fastening means comprise two sets of VELCRO® fasteners.

11. A personal floatation device according to claim 8, wherein the straps are connected to the fabric material with seams and the straps are fastened to the saddle with seams.

12. A personal floatation device according to claim 8, wherein the straps are each further provided with means allowing to adjust their length.

13. A personal floatation device according to claim 12, wherein means allowing to adjust the length of each strap comprise an adjustment buckle.

* * * * *